US012196051B2

(12) United States Patent
Murphy

(10) Patent No.: US 12,196,051 B2
(45) Date of Patent: Jan. 14, 2025

(54) TUBING HANGER ASSEMBLY WITH ADJUSTABLE LOAD NUT

(71) Applicant: FMC Technologies, Inc., Houston, TX (US)

(72) Inventor: Richard M. Murphy, Houston, TX (US)

( * ) Notice: Subject to any disclaimer, the term of this patent is extended or adjusted under 35 U.S.C. 154(b) by 0 days.

(21) Appl. No.: 18/585,996

(22) Filed: Feb. 23, 2024

(65) Prior Publication Data

US 2024/0191589 A1 Jun. 13, 2024

Related U.S. Application Data

(63) Continuation of application No. 18/102,035, filed on Jan. 26, 2023, now Pat. No. 11,920,423, which is a continuation of application No. 17/506,537, filed on Oct. 20, 2021, now Pat. No. 11,578,553, which is a continuation of application No. 16/755,576, filed as application No. PCT/US2017/060461 on Nov. 7, 2017, now Pat. No. 11,180,969.

(51) Int. Cl.
*E21B 33/04* (2006.01)
*E21B 33/043* (2006.01)

(52) U.S. Cl.
CPC ..... *E21B 33/0415* (2013.01); *E21B 33/043* (2013.01)

(58) Field of Classification Search
CPC ..... E21B 33/0415; E21B 33/043
See application file for complete search history.

(56) References Cited

U.S. PATENT DOCUMENTS 10,443,335 B2 * 10/2019 Finol ..... E21B 17/043
11,459,843 B2 * 10/2022 Bartlett ..... E21B 33/04

* cited by examiner

*Primary Examiner* — Aaron L Lembo
(74) *Attorney, Agent, or Firm* — Henry C. Query, Jr.

(57) ABSTRACT

A tubing hanger assembly includes a tubing hanger body, a downward facing load shoulder which is axially displaceable relative to the body, and first and second inclined surfaces which are configured to engage each other. One of the first and second inclined surfaces has a fixed axial position relative to the body and the other of the first and second inclined surfaces has a fixed axial position relative to the load shoulder. The first and second inclined surfaces are configured such that rotation of one of the first and second inclined surfaces relative to the other of the first and second inclined surfaces results in axial displacement of the load shoulder relative to the body.

20 Claims, 6 Drawing Sheets

TUBING HANGER ASSEMBLY WITH ADJUSTABLE LOAD NUT

The present application is a continuation of U.S. patent application Ser. No. 18/102,035 filed on Jan. 26, 2023, which is a continuation of U.S. patent application Ser. No. 17/506,537 filed on Oct. 20, 2021, which is a continuation of U.S. patent application Ser. No. 16/755,576 filed on Apr. 11, 2020, which is based on and claims priority from International Patent Application No. PCT/US2017/060461 filed on Nov. 7, 2017.

FIELD OF THE DISCLOSURE

The present disclosure is directed to a subsea hydrocarbon production system which includes a tubing hanger installed in a wellhead or the like. More particularly, the disclosure is directed to a tubing hanger assembly having a body, a downward facing load shoulder which is axially displaceable relative to the body, and first and second inclined surfaces which are configured such that rotation of one of the first and second inclined surfaces relative to the other of the first and second inclined surfaces results in axial displacement of the load shoulder relative to the body. In this manner, the load shoulder can be adjusted so that the vertical distance between the load shoulder and a tubing hanger lockdown mechanism is the same as the vertical distance between the seat on which the load shoulder is landed and a wellhead locking profile which the lockdown mechanism is configured to engage.

BACKGROUND OF THE DISCLOSURE

Subsea hydrocarbon production systems typically include a wellhead which is positioned at the upper end of a well bore. The wellhead comprises a central bore within which a number of casing hangers are landed. Each casing hanger is connected to the top of a corresponding one of a number of concentric, successively smaller casing strings which extend into the well bore, with the uppermost casing hanger being connected to the innermost casing string. After the innermost casing string is installed, a tubing string is run into the well bore. The top of the tubing string is connected to a tubing hanger having a downward facing circumferential load shoulder which lands on a seat formed at the top of the uppermost casing hanger. In certain tubing hangers, the load shoulder is formed on a load nut which is threadedly connected to the tubing hanger body.

The tubing hanger is usually secured to the wellhead using a lockdown mechanism, such as a lock ring or a number of locking dogs, both of which comprise a number of axially spaced, circumferential locking ridges. The locking dogs are supported on the tubing hanger body and are expandable radially outwardly into a locking profile formed in the bore of the wellhead, such as a number of axially spaced, circumferential locking grooves, each of which is configured to receive a corresponding locking ridge. In order to ensure that the tubing hanger is properly locked to the wellhead, the vertical distance between the load shoulder and the locking dogs must be the same as the vertical distance between the seat and the locking profile, which is commonly referred to as the wellhead space-out. In this regard, the term "the same as" should be interpreted to mean that the vertical distance between the seat and the locking profile is such that the locking ridges can fully engage their corresponding locking grooves.

In tubing hangers in which the load shoulder is formed on a load nut that is threadedly connected to the tubing hanger body, the vertical distance between the load shoulder and the locking dogs can be adjusted by rotating the load nut relative to the tubing hanger body. Thus, once the wellhead space-out is determined, the load nut can be rotated until the vertical distance between the load shoulder and the locking dogs is the same as the wellhead space-out.

In the prior art, a lead impression tool (LIT) is sometimes used to measure the wellhead space-out. In subsea wellheads, the LIT is lowered on a drill string and landed on the seat. The LIT is then hydraulically actuated to press typically three circumferentially spaced lead impression pads into the locking profile. After the impressions are taken, the LIT is retrieved to the surface and mounted on a storage/test stand, which is then manually adjusted to match the lead impression tool. The tubing hanger is then mounted on the storage/test stand and the load nut is adjusted until the vertical distance between the load shoulder and the locking dogs is the same as the wellhead space-out.

Although the LIT provides a useful means for determining the wellhead space-out, the time required to run and retrieve the LIT can be relatively long, especially in deep water. Also, setting the tubing hanger on the storage/test stand and adjusting the load nut can be a time consuming process and is dependent on human interpretation.

SUMMARY OF THE DISCLOSURE

In accordance with one embodiment of the present disclosure, a tubing hanger assembly is provided which comprises a tubing hanger body; a downward facing load shoulder which is axially displaceable relative to the body; and first and second inclined surfaces configured to engage each other, one of the first and second inclined surfaces having a fixed axial position relative to the body and the other of the first and second inclined surfaces having a fixed axial position relative to the load shoulder; wherein the first and second inclined surfaces are configured such that rotation of one of the first and second inclined surfaces relative to the other of the first and second inclined surfaces results in axial displacement of the load shoulder relative to the body.

In accordance with one aspect of the disclosure, one of the first and second inclined surfaces may be located on a load member rotatably positioned on the body.

In accordance with another aspect of the disclosure, the other of the first and second inclined surfaces may be non-rotatable relative to the body.

In accordance with a further aspect of the disclosure, one of the first and second inclined surfaces may be formed on the body and both the load shoulder and the other of the first and second inclined surfaces may be formed on a load member which is rotatably supported on the body.

In accordance with yet another aspect of the disclosure, one of the first and second inclined surfaces may be defined by a first set of threads formed on the body and the other of the first and second inclined surfaces may be defined by a second set of threads formed on a load member which is rotatably supported on the body and on which the load shoulder is formed.

In accordance with one aspect of the disclosure, a force required to rotate one of the first and second inclined surfaces relative to the other of the first and second inclined surfaces may be generated by a force member operatively engaged between a first portion of the tubing hanger assembly which is fixed in position relative to the first inclined surface and a second portion of the tubing hanger assembly which is fixed in position relative to the second inclined surface.

In accordance with another aspect of the disclosure, the force member may comprise a spring operatively engaged between the first and second portions of the tubing hanger assembly.

In accordance with a further aspect of the disclosure, the tubing hanger assembly may comprise a latch member supported on a first portion of the tubing hanger assembly which is fixed in position relative to the first inclined surface, the latch member being movable into engagement with a second portion of the tubing hanger assembly which is fixed in position relative to the second inclined surface to thereby prevent relative rotation between the first and second inclined surfaces.

The present disclosure is also directed to a method of installing a tubing hanger assembly in a wellhead. The method comprises providing the tubing hanger assembly with a tubing hanger body, a downward facing load shoulder which is axially displaceable relative to the body, and first and second inclined surfaces configured to engage each other, one of the first and second inclined surfaces having a fixed axial position relative to the body and the other of the first and second inclined surfaces having a fixed axial position relative to the load shoulder, wherein the first and second inclined surfaces are configured such that rotation of one of the first and second inclined surfaces relative to the other of the first and second inclined surfaces results in axial displacement of the load shoulder relative to the body; lowering the tubing hanger assembly into the wellhead until the load shoulder is positioned on or axially adjacent an upward facing seat located in the wellhead; engaging a first lockdown feature on the tubing hanger assembly with a second lockdown feature in the wellhead to thereby secure the tubing hanger to the wellhead; and rotating the first and second inclined surfaces relative to each until the distance between the first lockdown feature and the load shoulder is the same as the distance between the second lockdown feature and the seat; wherein a force required to rotate the first and second inclined surfaces relative to each other is generated by a force member located in the tubing hanger assembly.

In accordance with one aspect of the disclosure, the method may comprise, prior to the step of rotating the first and second inclined surfaces relative to each other, preloading the first and second lockdown features against each other.

In accordance with another aspect of the disclosure, one of the first and second inclined surfaces may be located on a load member rotatably positioned on the body, and the step of rotating the first and second inclined surfaces relative to each other may comprise rotating the load member relative to the body.

In accordance with a further aspect of the disclosure, one of the first and second inclined surfaces may be formed on the body, both the load shoulder and the other of the first and second inclined surfaces may be formed on a load member which is rotatably supported on the body, and the step of rotating the first and second inclined surfaces relative to each other may comprise rotating the load member relative to the body.

In accordance with yet another aspect of the disclosure, one of the first and second inclined surfaces may be defined by a first set of threads formed on the body, the other of the first and second inclined surfaces may be defined by a second set of threads formed on a load member which is rotatably supported on the body and on which the load shoulder is formed, and the step of rotating the first and second inclined surfaces relative to each other may comprise rotating the load member relative to the body.

In accordance with yet a further aspect of the disclosure, the method may further comprising, prior to the step of rotating the first and second inclined surfaces relative to each other, preventing the first and second inclined surfaces from rotating relative to each other.

Thus, in one illustrative embodiment of the disclosure, the tubing hanger assembly enables the vertical spacing between the load shoulder and a tubing hanger lockdown feature to be adjusted in real time as the tubing hanger is landed and locked in the wellhead. As a result, the need to measure the wellhead space-out and adjust the position of the load nut before the tubing hanger is run into the wellhead is eliminated, which greatly reduces the time required to install the tubing hanger.

These and other objects and advantages of the present disclosure will be made apparent from the following detailed description, with reference to the accompanying drawings. In the drawings, the same reference numbers may be used to denote similar components in the various embodiments.

DETAILED DESCRIPTION

Figure 1:
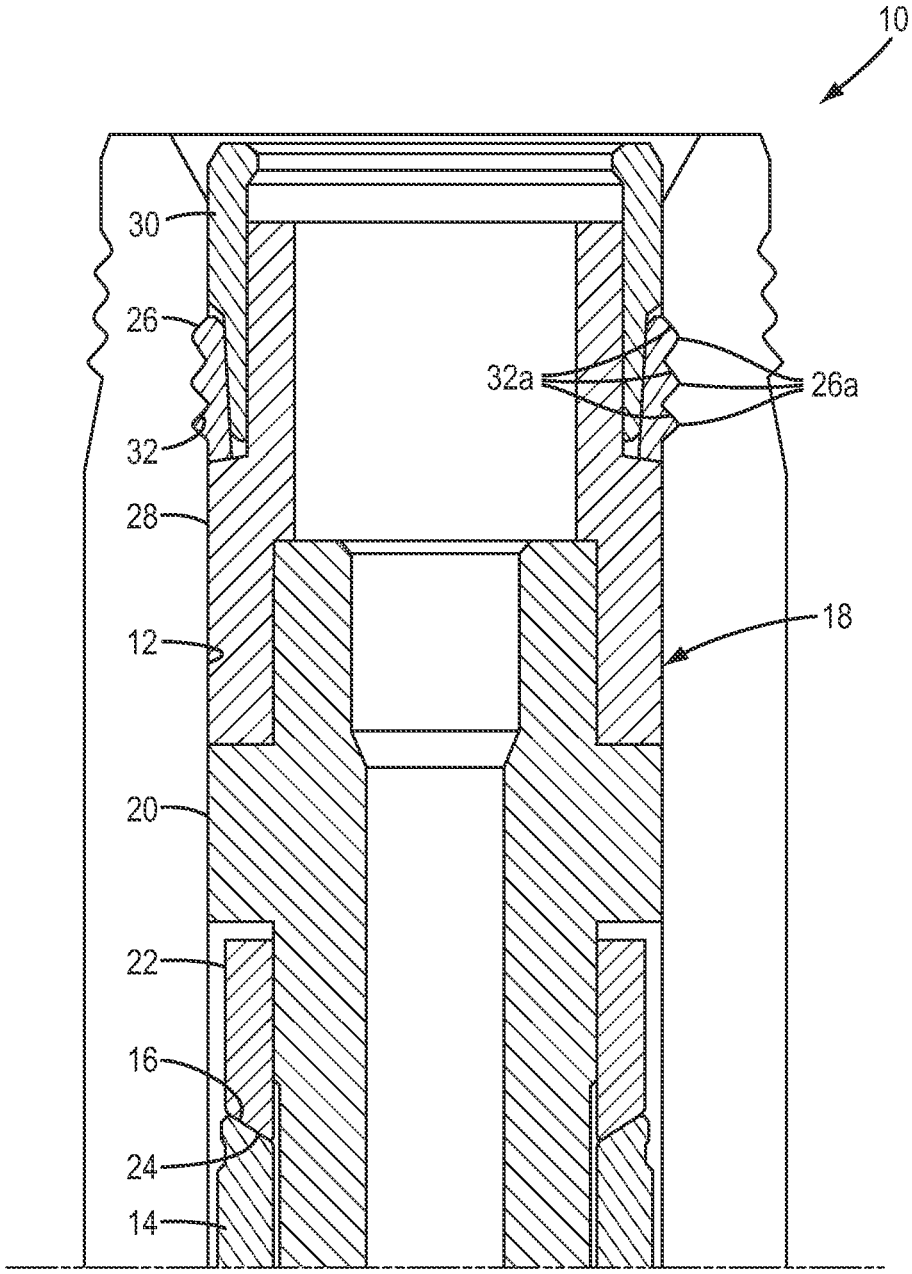
FIG. 1 is a cross sectional view of an example of a prior art wellhead system.

An example of a prior art wellhead system is shown in FIG. 1. The wellhead system includes a wellhead 10 (only the upper portion of which is shown) which is positioned at the top of a well bore (not shown). The wellhead 10 comprises a central bore 12 within which a number of casing hangers are landed, including an uppermost casing hanger 14 (only the upper portion of which is shown). The top of the casing hanger 14 is configured as a seat 16 on which a tubing hanger 18 is landed. The tubing hanger 18 includes a cylindrical body 20 and a load nut 22 which is threadedly connected to the body. The load nut 22 comprises a load shoulder 24 which engages the seat 16 when the tubing hanger 18 is landed in the wellhead 10.

The tubing hanger 18 is secured to the wellhead 10 using a suitable lockdown mechanism. In the example shown in FIG. 1, the lockdown mechanism includes a lock ring or a number of expandable locking dogs 26 which are supported on a lockdown ring 28 that is connected to the tubing hanger body 20. After the tubing hanger 18 is landed in the wellhead 10, a locking mandrel 30 is actuated to drive the locking dogs 26 into a locking profile 32 which is formed in the central bore 12. This action forces a number of axially spaced, circumferential locking ridges 26*a* formed on the locking dogs 26 into a corresponding number of axially spaced, circumferential locking ridges 32*a* formed in the locking profile 32 to thereby secure the tubing hanger to the wellhead.

As discussed above, in order to ensure that the tubing hanger 18 is properly locked to the wellhead 10, the vertical distance between the load shoulder 24 and the locking dogs 26 must be the same as the vertical distance between the seat 16 and the locking profile 32 (i.e., the wellhead space-out). The wellhead space-out may be determined using, e.g., a lead impression tool (LIT). In the wellhead system shown in FIG. 1, for example, the LIT would be lowered on a drill string and landed on the seat 16. The LIT would then be actuated to press a number of circumferentially spaced lead impression pads into the locking profile 32. After the impressions are taken, the LIT would be retrieved to the surface and mounted on a storage/test stand, which would then be manually adjusted to match the LIT. After this step, the tubing hanger 18 would be mounted on the storage/test stand and the load nut 22 would be manually rotated until the vertical distance between the load shoulder 24 and the locking dogs 26 is the same as the vertical distance between the seat and the locking profile. As may be apparent, this method for determining the wellhead space-out and adjusting the load nut until the vertical distance between the load shoulder and the locking dogs is the same as the wellhead space-out is a relatively time consuming process.

In accordance with the present disclosure, a tubing hanger and adjustable load nut assembly is provided which enables the vertical spacing between the load shoulder and the locking dogs to be adjusted automatically. As a result, the need to measure the wellhead space-out and adjust the position of the load nut before the tubing hanger is run into the wellhead is eliminated, which greatly reduces the time required to install the tubing hanger.

Figure 2:
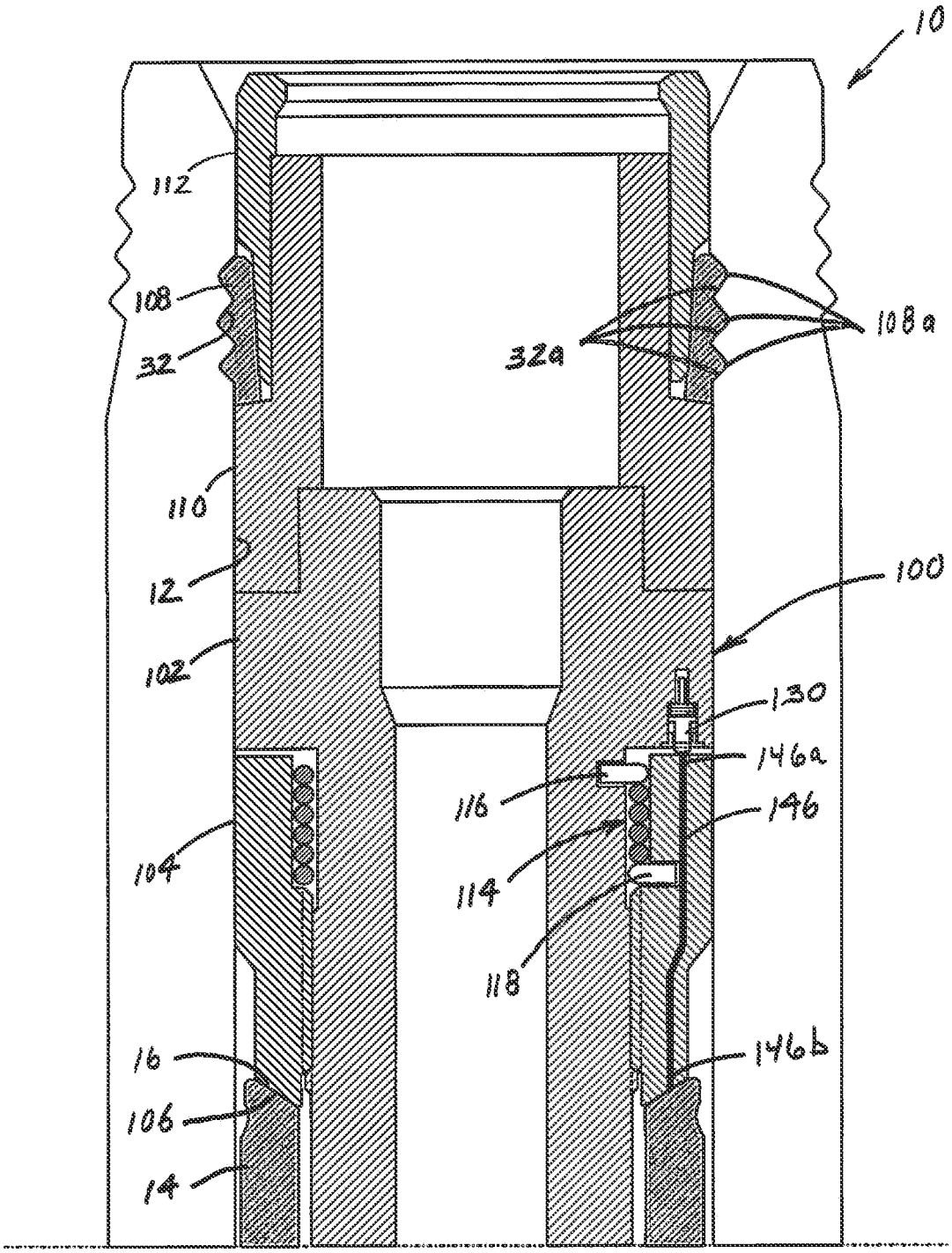
FIG. 2 is a cross sectional representation of an embodiment of the tubing hanger and adjustable load nut assembly of the present disclosure shown immediately after the tubing hanger has been landed in a wellhead and the tubing hanger lockdown mechanism has been engaged.

An illustrative embodiment of a tubing hanger and adjustable load nut assembly of the present disclosure is shown in FIG. 2. In FIG. 2, the tubing hanger, which is indicated generally by reference number 100, is shown landed and locked, but not yet pre-tensioned, in a representative wellhead 10. Similar to the example described above in connection with FIG. 1, the wellhead 10 comprises a central bore 12 within which a number of casing hangers are landed, including an uppermost casing hanger 14 (only the upper portion of which is shown). In this example, the top of the casing hanger 14 is configured as an upward facing seat 16 on which the tubing hanger 100 is landed.

Figure 5:
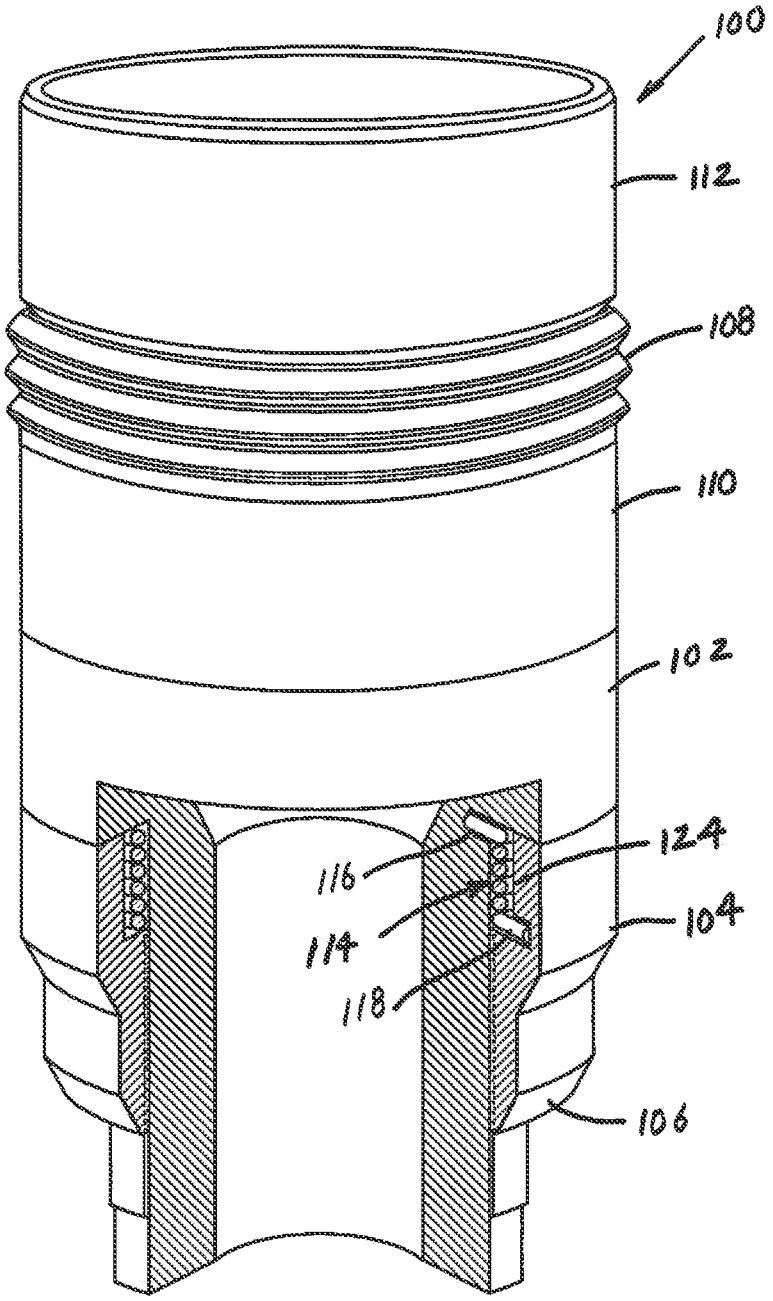
FIG. 5 is a perspective, partially cutaway view of an embodiment of the tubing hanger and adjustable load nut assembly of the present disclosure showing the load nut in its initial or upper position.

Referring also to FIG. 5, the tubing hanger 100 includes an axially extending body 102 comprising an annular outer surface. A load nut 104 is threadedly connected to the body 102 and includes a downward facing load shoulder 106 which engages the seat 16 when the tubing hanger 100 is landed in the wellhead 10. Due to the threaded connection between the load nut 104 and the body 102, rotation of the load nut relative to the body will result in axial displacement of the load nut relative to the body.

The tubing hanger 100 is secured to the wellhead 10 by engagement of interacting lockdown features on the tubing hanger and the wellhead. The lockdown features may comprise any suitable means for securing the tubing hanger to the wellhead. For example, the wellhead may comprise a locking profile in the central bore which is engaged by a lock ring carried on the tubing hanger or on a separate lockdown mandrel or similar device. As another example, the tubing hanger may comprise a locking profile on the outer surface which is engaged by a number of locking pins or similar devices mounted on the wellhead.

In the example shown in FIG. 2, the tubing hanger lockdown feature comprises a number of expandable locking dogs 108 which are supported on a lockdown ring 110 that is connected to the tubing hanger body. Alternatively, the locking dogs may be supported directly on the tubing hanger body 102. Also, the wellhead lockdown feature comprises a locking profile 32 which is formed in the central bore 12. As with the locking dogs 26 described above, the locking dogs 108 in this example embodiment comprise a number of axially spaced, circumferential locking ridges 108*a* which are configured to be received in the axially spaced, circumferential locking grooves 32*a* of the locking profile 32. In this example, after the tubing hanger 100 is landed in the wellhead 10, a locking mandrel 112 is actuated to drive the locking ridges 108*a* into the locking grooves 32*a* to thereby secure the tubing hanger to the wellhead.

As discussed above, in order to ensure that the tubing hanger 100 is properly locked to the wellhead 10, the vertical distance between the load shoulder 106 and the locking dogs 108 must be the same as the vertical distance between the seat 16 and the locking profile 32. In the prior art, the vertical distance between the load shoulder 106 and the locking dogs 108 was adjusted manually. In accordance with the present disclosure, after the tubing hanger 100 is landed and locked in the wellhead 10, and preferably also pre-tensioned from above, the vertical distance between the load shoulder 106 and the locking dogs 108 is adjusted automatically using a novel torsion spring arrangement.

Figure 4:
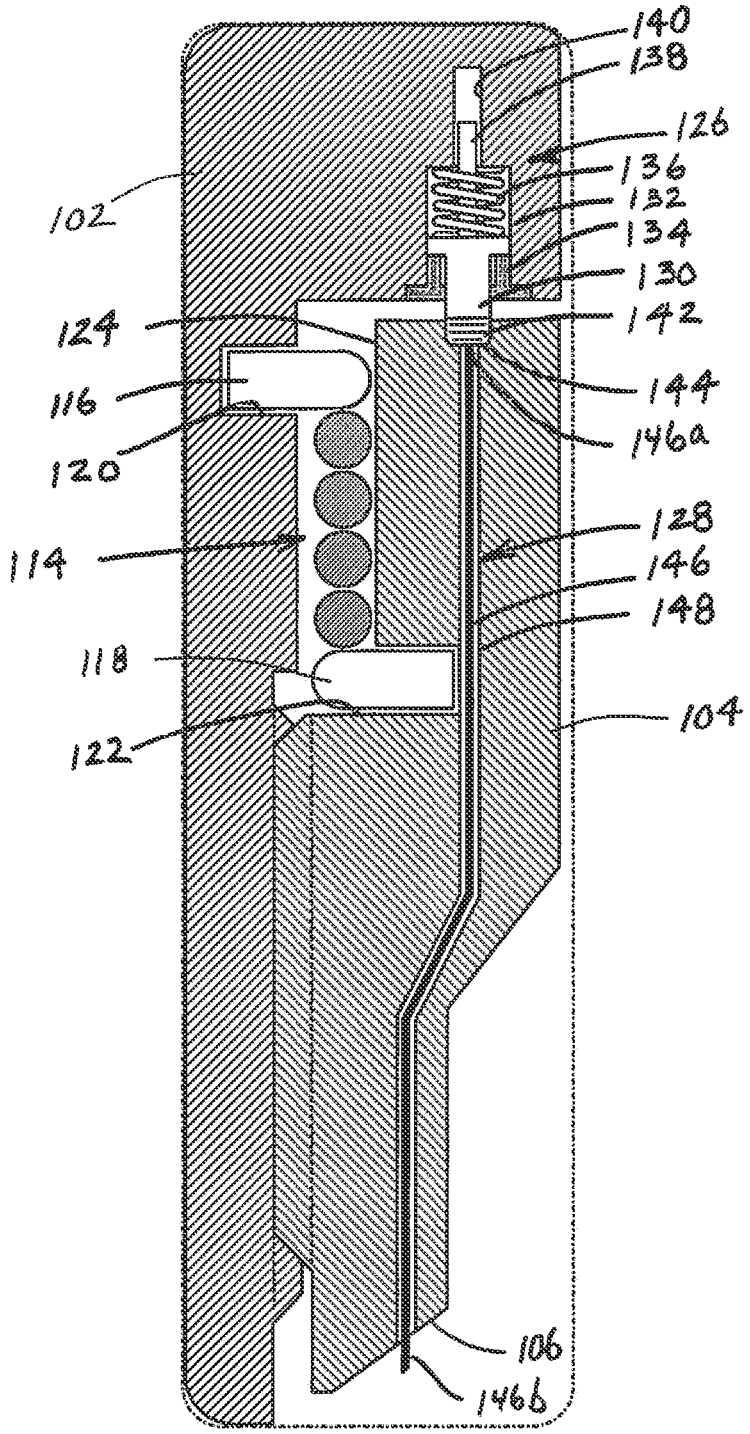
FIG. 4 is an enlarged cross sectional view of an illustrative embodiment of the load nut latching mechanism of the present disclosure.

Referring also to FIG. 4, the torsion spring arrangement includes a torsion spring 114 which is operatively engaged between the tubing hanger body 102 and the load nut 104. The torsion spring 114 is a helically wound member which comprises a radially inwardly extending first end 116 that is secured to the tubing hanger body 102 and a radially outwardly extending second end 118 that is secured to the load nut 104. In the illustrative embodiment of the invention shown in the drawings, the first end 116 may be received in a corresponding first hole 120 which is formed in the tubing hanger body 102 and the second end 118 may be received in a corresponding second hole 122 which is formed in the load nut 104. In addition, the torsion spring 114 may be positioned in a circumferential recess 124 which is formed in the inner diameter surface of the load nut 104 (but may alternatively be formed in the outer diameter surface of the tubing hanger body 102).

During assembly of the tubing hanger 100, the load nut 104 is threaded onto the tubing hanger body 102 until it reaches an initial or upper position, which is shown in FIGS. 4 and 5. As the load nut 104 is threaded onto the tubing hanger body 102, the torsion spring 114 is wound from a relaxed state to a torqued state. In this position, mechanical energy is stored in the torsion spring 114 which will generate a torque on the load nut 104 that will cause the load nut to rotate relative to the tubing hanger body 102. Due to the threaded connection between the load nut 104 and the body 102, this rotation will displace the load nut axially downward relative to the body and thereby increase the vertical distance between the load shoulder 106 and the locking dogs 108.

In order to maintain the torsion spring 114 in its torqued state, the tubing hanger 100 also includes means for preventing the load nut 104 from rotating relative to the tubing hanger body 102 until after the tubing hanger is landed in the wellhead 10. Referring to FIG. 4, for example, the tubing hanger and adjustable load nut assembly may include a latching mechanism 126 which is positioned in the tubing hanger body 102 and a de-latching mechanism 128 which is positioned in the load nut 104. In this example, the latching mechanism 126 comprises a latch member 130 which is slidably positioned in a bore 132 that is formed in a portion of the tubing hanger body 102 located proximate the upper surface of the load nut 104. The latch member 130 may be maintained in the bore 132 by a suitable gland nut 134 and may be biased toward the load nut 104 by a compression spring 136. The latch member 130 may also include an alignment pin 138 which extends vertically into a guide bore 140 that is formed in the tubing hanger body 102.

In this example, when the load nut 104 is in its initial position, a distal end 142 of the latch member 130 will be positioned in a corresponding groove 144 formed in the upper surface of the load nut. In this position, the spring 136 will bias the latch member 130 toward the load nut 104 with sufficient force to maintain the distal end 142 of the latch member fully engaged in the groove 144 and thus prevent the torsion spring 114 from rotating the load nut relative to the tubing hanger body 102.

In the illustrative embodiment shown in FIG. 4, the de-latching mechanism 128 functions to force the distal end 142 of the latch member 130 out of the groove 144 when the tubing hanger 100 lands in the wellhead 10. As shown in FIG. 4, the de-latching mechanism 128 may comprise an axially stiff but radially flexible rod 146 which is positioned in an axially extending through bore 148 formed in the load nut 104. The rod 146 includes a first end 146*a* which is located proximate the bottom of the groove 144 and a second end 146*b* which extends a distance below the load shoulder 106. In this manner, when the tubing hanger 100 lands in the wellhead 10, the seat 16 (not shown in FIG. 4) will contact the second end 146*b* and force the rod 146 axially upwardly, and the first end 146*a* will in turn force the distal end 142 of the latch member 130 out of the groove 144, thus permitting the load nut 104 to rotate relative to the tubing hanger body 102 as the torsion spring 114 unwinds.

During installation, the tubing hanger 100 is connected to a drill string and lowered from a surface vessel toward the wellhead 10. The tubing hanger 100 is lowered into the wellhead 10 until the load shoulder 106 on the adjustable load nut 104 lands on the seat 16 at the top of the casing hanger 14. As shown in FIG. 2, this action will force the rod 146 upward and displace the distal end 142 of the latch member 130 from the groove 144. In this position, the weight of the tubing hanger 100 and its depending tubing string (not shown) acting on the casing hanger 14 will prevent the torsion spring 114 from unwinding and rotating the load nut 104 relative to the tubing hanger body 102. The tubing hanger 100 is then locked to the wellhead by forcing the locking dogs 108 into the locking profile 32.

Figure 3:
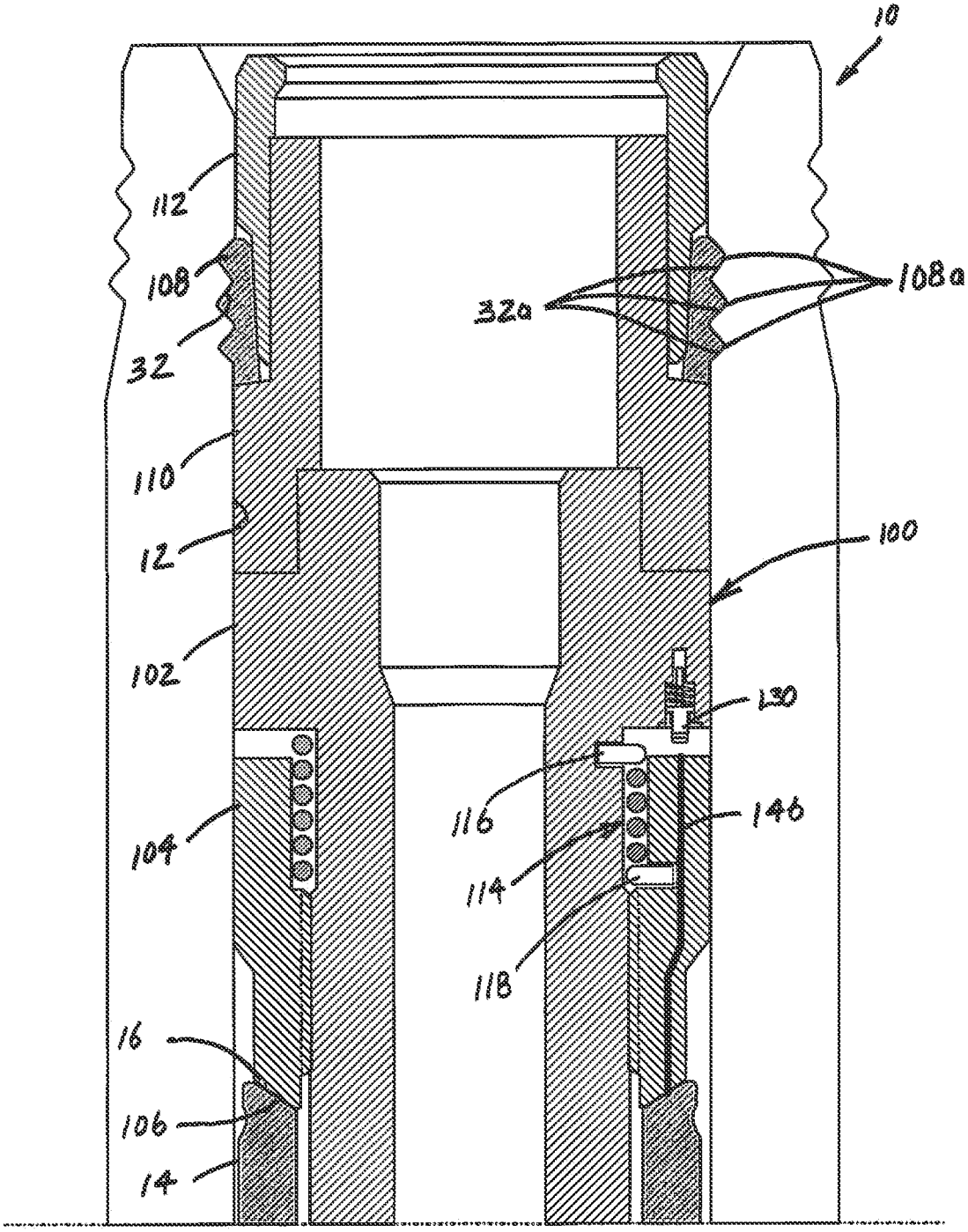
FIG. 3 is a cross sectional representation of the tubing hanger and adjustable load nut assembly of FIG. 2 shown immediately after the tubing hanger has been preloaded and the load nut has expanded into engagement with the landing seat.
Figure 6:
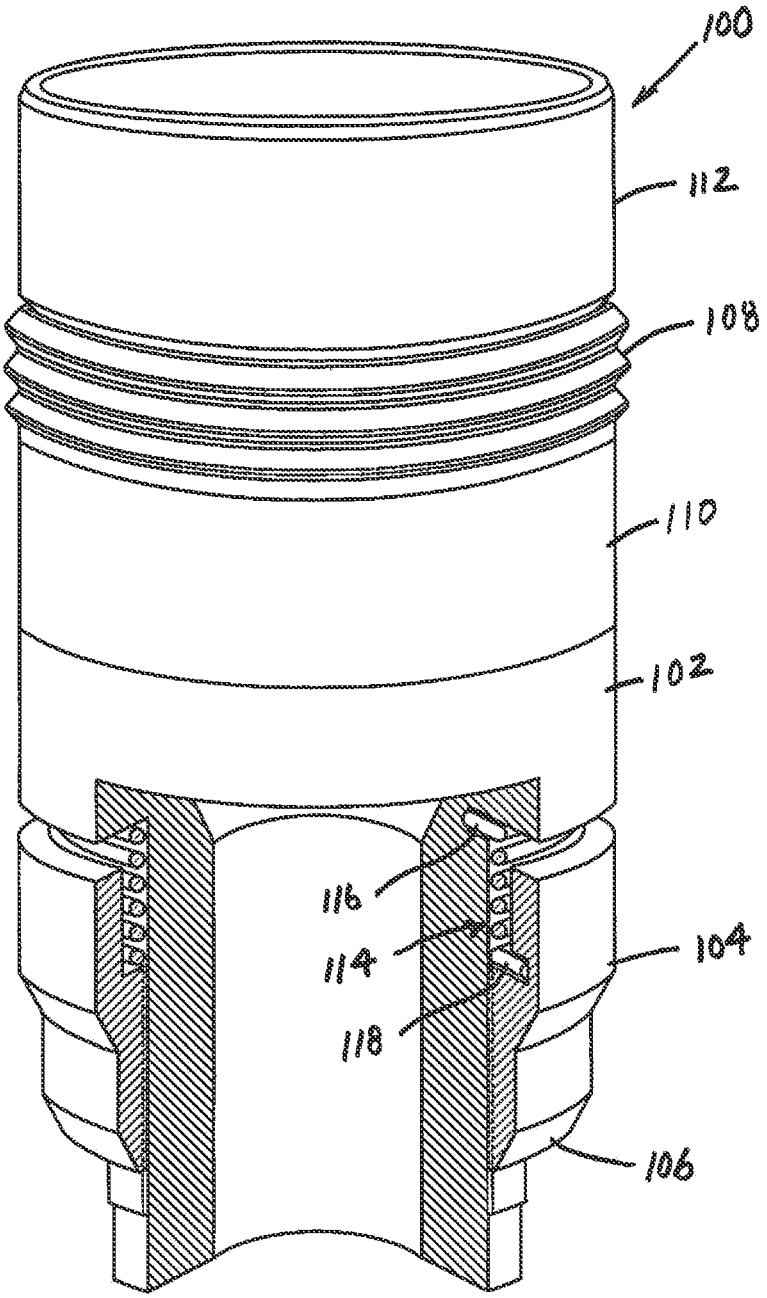
FIG. 6 is a perspective, partially cutaway view of the tubing hanger and adjustable load nut assembly of FIG. 5 showing the load nut in its final or lower position.

Once the tubing hanger 100 is locked to the wellhead 10, tension is applied to the drill string to lift the tubing hanger upward until the upper facing portions of the locking ridges 108*a* are fully loaded against the corresponding downward facing portions of the locking grooves 32*a*. During this process, the load nut 104 is lifted off of the landing seat 106. Since the latch member 130 is no longer engaged with the groove 144 in the top of the load nut 104, the torsion spring 114 will force the load nut to rotate downward relative to the tubing hanger body 102 until the landing shoulder 106 is once again fully engaged with the landing seat 106. This is the position of the load nut 104 shown in FIGS. 3 and 6. In this position, the locking dogs 108 will be fully preloaded with the locking grooves 32, thus minimizing possible fretting of the metal tubing hanger annulus seals (not shown) due to the development of thermal gradients during production startups and shutdowns.

In other embodiments, the latching and de-latching mechanisms may take different forms from those described above. For example, the latch member 130 may be mounted on the load nut 104 and be biased by a spring 136 or other suitable means into engagement with a corresponding groove formed in the tubing hanger body 102. In this example, the de-latching mechanism may comprise a rod or pin which is linked to the latch member 130 and which functions to retract the latch member from the groove when the rod or pin engages the seat 16 or a corresponding feature in the central bore 12 of the wellhead 10.

In another example, the latch member 130 shown in FIG. 4 may be sealed to the bore 132 in the manner of a piston. In this example, the de-latching mechanism may comprise a source of pressurized fluid which is located on, e.g., a surface vessel or a tubing hanger running tool which is used to install the tubing hanger 100. The source of pressurized fluid may be operationally connected to the latch member 130 via a conduit in the tubing hanger running tool which is connected to a corresponding conduit in the tubing hanger body 102 that in turn is connected to the bore 132 (or the alignment bore 140). In operation of this embodiment, once the tubing hanger 100 is landed on the seat 16, a negative pressure from the source of pressurized fluid is applied to the bore 132 to retract the latch member 130 from the groove 144.

In a variation of this embodiment, the spring 136 may be removed and the source of pressurized fluid may be used to both extend the latch member 130 into the groove 144 (by applying a positive pressure to the bore 132) and retract the latch member from the groove 144 (by applying a negative pressure to the bore 132).

In a further variation, the spring 136 may comprise an extension spring which functions to retract the latch member 130 from the groove 144. In this example, the source of pressurized fluid may be used to maintain the latch member in the groove until the tubing hanger 100 is landed on the seat 16, at which point the pressure can be released to allow the latch member 130 to retract from the groove.

In a further embodiment, the latching and de-latching mechanisms may comprise a number of shear pins or the like which are connected between the load nut 104 and the tubing hanger body 102.

Although the torsion spring arrangement has been described herein in the context of a tubing hanger which is landed on a casing hanger supported in a wellhead, it should be understood that it could be used in other applications, either within or outside of the field of subsea hydrocarbon production systems. In the field of subsea hydrocarbon production systems, for example, the torsion spring arrangement could be used to obtain proper spacing between any tubular hanger and any component within which the tubular hanger is landed, such as, e.g., a tubing spool or tubing head.

More generally, the present disclosure provides a torsion spring arrangement for use in securing an inner member to an outer member which surrounds at least a portion of the inner member. In one embodiment, the outer member comprises first and second axially spaced outer features and the inner member comprises first and second axially spaced inner features which are configured to engage the outer features to secure the inner member to the outer member. The first inner feature is formed on a component which is threadedly connected to the inner member, and the torsion spring arrangement is operable to rotate the component to thereby move the first inner feature axially relative to the inner member until the first and second inner features engage the first and second outer features, respectively, to secure the inner member to the outer member. Alternatively, the first outer feature may be formed on a component which is threadedly connected to the outer member, and the torsion spring arrangement may be operable to rotate the component to thereby move the first outer feature axially relative to the outer member until the first and second inner features engage the first and second outer features, respectively, to secure the inner member to the outer member.

It should be recognized that, while the present disclosure has been presented with reference to certain embodiments, those skilled in the art may develop a wide variation of structural and operational details without departing from the principles of the disclosure. For example, the various elements shown in the different embodiments may be combined in a manner not illustrated above. Therefore, the following claims are to be construed to cover all equivalents falling within the true scope and spirit of the disclosure.

What is claimed is:

1. A tubing hanger assembly comprising:

a tubing hanger body;

a downward facing load shoulder which is axially displaceable relative to the body; and first and second inclined surfaces configured to engage each other, one of the first and second inclined surfaces having a fixed axial position relative to the body and the other of the first and second inclined surfaces having a fixed axial position relative to the load shoulder;

wherein the first and second inclined surfaces are configured such that rotation of one of the first and second inclined surfaces relative to the other of the first and second inclined surfaces results in axial displacement of the load shoulder relative to the body; and wherein a force required to rotate one of the first and second inclined surfaces relative to the other of the first and second inclined surfaces is generated by a force member operatively engaged between a first portion of the tubing hanger assembly which is fixed in position relative to the first inclined surface and a second portion of the tubing hanger assembly which is fixed in position relative to the second inclined surface.

2. The tubing hanger assembly of claim 1, wherein one of the first and second inclined surfaces is located on a load member rotatably positioned on the body.

3. The tubing hanger assembly of claim 2, wherein the other of the first and second inclined surfaces is non-rotatable relative to the body.

4. The tubing hanger assembly of claim 1, wherein one of the first and second inclined surfaces is formed on the body and both the load shoulder and the other of the first and second inclined surfaces are formed on a load member which is rotatably supported on the body.

5. The tubing hanger assembly of claim 1, wherein one of the first and second inclined surfaces is defined by a first set of threads formed on the body and the other of the first and second inclined surfaces is defined by a second set of threads formed on a load member which is rotatably supported on the body and on which the load shoulder is formed.

6. The tubing hanger assembly of any one of claims 1-5, wherein the force member comprises a spring operatively engaged between the first and second portions of the tubing hanger assembly.

7. The tubing hanger assembly of any one of claims 1-5, further comprising a latch member supported on a first portion of the tubing hanger assembly which is fixed in position relative to the first inclined surface, the latch member being movable into engagement with a second portion of the tubing hanger assembly which is fixed in position relative to the second inclined surface to thereby prevent relative rotation between the first and second inclined surfaces.

8. A method of installing a tubing hanger assembly in a wellhead, the method comprising:

providing the tubing hanger assembly with:

a tubing hanger body;

a downward facing load shoulder which is axially displaceable relative to the body; and first and second inclined surfaces configured to engage each other, one of the first and second inclined surfaces having a fixed axial position relative to the body and the other of the first and second inclined surfaces having a fixed axial position relative to the load shoulder;

wherein the first and second inclined surfaces are configured such that rotation of one of the first and second inclined surfaces relative to the other of the first and second inclined surfaces results in axial displacement of the load shoulder relative to the body;

lowering the tubing hanger assembly into the wellhead until the load shoulder is positioned on or axially adjacent an upward facing seat located in the wellhead;

engaging a first lockdown feature on the tubing hanger assembly with a second lockdown feature in the wellhead to thereby secure the tubing hanger to the wellhead; and rotating the first and second inclined surfaces relative to each until the distance between the first lockdown feature and the load shoulder is the same as the distance between the second lockdown feature and the seat;

wherein a force required to rotate the first and second inclined surfaces relative to each other is generated by a force member located in the tubing hanger assembly.

9. The method of claim 8, further comprising, prior to the step of rotating the first and second inclined surfaces relative to each other, preloading the first and second lockdown features against each other.

10. The method of claim 8 or 9, wherein one of the first and second inclined surfaces is located on a load member rotatably positioned on the body, and wherein the step of rotating the first and second inclined surfaces relative to each other comprises rotating the load member relative to the body.

11. The method of claim 8 or 9, wherein one of the first and second inclined surfaces is formed on the body, wherein both the load shoulder and the other of the first and second inclined surfaces are formed on a load member which is rotatably supported on the body, and wherein the step of rotating the first and second inclined surfaces relative to each other comprises rotating the load member relative to the body.

12. The method of claim 8 or 9, wherein one of the first and second inclined surfaces is defined by a first set of threads formed on the body, wherein the other of the first and second inclined surfaces is defined by a second set of threads formed on a load member which is rotatably supported on the body and on which the load shoulder is formed, and wherein the step of rotating the first and second inclined surfaces relative to each other comprises rotating the load member relative to the body.

13. The method of claim 8 or 9, further comprising, prior to the step of rotating the first and second inclined surfaces relative to each other, preventing the first and second inclined surfaces from rotating relative to each other.

14. A tubing hanger assembly comprising:

a tubing hanger body;

a downward facing load shoulder which is axially displaceable relative to the body; and first and second inclined surfaces configured to engage each other, one of the first and second inclined surfaces having a fixed axial position relative to the body and the other of the first and second inclined surfaces having a fixed axial position relative to the load shoulder;

wherein the first and second inclined surfaces are configured such that rotation of one of the first and second inclined surfaces relative to the other of the first and second inclined surfaces results in axial displacement of the load shoulder relative to the body; and wherein the tubing hanger assembly further comprises a latch member supported on a first portion of the tubing hanger assembly which is fixed in position relative to the first inclined surface, the latch member being movable into engagement with a second portion of the tubing hanger assembly which is fixed in position relative to the second inclined surface to thereby prevent relative rotation between the first and second inclined surfaces.

15. The tubing hanger assembly of claim 14, wherein one of the first and second inclined surfaces is located on a load member rotatably positioned on the body.

16. The tubing hanger assembly of claim 15, wherein the other of the first and second inclined surfaces is non-rotatable relative to the body.

17. The tubing hanger assembly of claim 14, wherein one of the first and second inclined surfaces is formed on the body and both the load shoulder and the other of the first and second inclined surfaces are formed on a load member which is rotatably supported on the body.

18. The tubing hanger assembly of claim 14, wherein one of the first and second inclined surfaces is defined by a first set of threads formed on the body and the other of the first and second inclined surfaces is defined by a second set of threads formed on a load member which is rotatably supported on the body and on which the load shoulder is formed.

19. The tubing hanger assembly of any one of claims 14-18, wherein a force required to rotate one of the first and second inclined surfaces relative to the other of the first and second inclined surfaces is generated by a force member operatively engaged between a first portion of the tubing hanger assembly which is fixed in position relative to the first inclined surface and a second portion of the tubing hanger assembly which is fixed in position relative to the second inclined surface.

20. The tubing hanger assembly of claim 19, wherein the force member comprises a spring operatively engaged between the first and second portions of the tubing hanger assembly.

* * * * *